US008997358B2

(12) United States Patent
Huang

(10) Patent No.: US 8,997,358 B2
(45) Date of Patent: Apr. 7, 2015

(54) BOX CUTTER WITH RETRACTABLE BLADE

(71) Applicant: Yin Han Huang, Taichung (TW)

(72) Inventor: Yin Han Huang, Taichung (TW)

( * ) Notice: Subject to any disclaimer, the term of this patent is extended or adjusted under 35 U.S.C. 154(b) by 230 days.

(21) Appl. No.: 13/775,162

(22) Filed: Feb. 23, 2013

(65) Prior Publication Data

US 2014/0053410 A1 Feb. 27, 2014

(30) Foreign Application Priority Data

Aug. 21, 2012 (TW) ..... 101130183 A

(51) Int. Cl.
*B26B 3/06* (2006.01)
*B26B 1/08* (2006.01)
*B26B 5/00* (2006.01)

(52) U.S. Cl.
CPC . *B26B 1/08* (2013.01); *B26B 5/001* (2013.01); *B26B 5/003* (2013.01)

(58) Field of Classification Search
CPC ..... B26B 1/08; B26B 5/00; B26B 5/001; B26B 5/003; B26B 5/005; B26B 5/006
USPC ..... 30/2, 105, 151, 152, 159, 162; 7/142
See application file for complete search history.

(56) References Cited

U.S. PATENT DOCUMENTS 7,765,701 B2 * 8/2010 Okada ..... 30/162

* cited by examiner

*Primary Examiner* — Ned Landrum
*Assistant Examiner* — Liang Dong
(74) *Attorney, Agent, or Firm* — Muncy, Geissler, Olds & Lowe, P.C.

(57) ABSTRACT

A box cutter includes a housing with a blade slide slidably received therein. A pivotal member is pivotably connected to of the blade slide. An inclined face is defined in one of surfaces of the pivotal member and is gradually raised. The inclined face is connected to a pressing area which has two respective rounded guide portions. A spring is connected between the pivotal member and the housing to maintain the blade slide at the initial position. A button is slidably connected to outside of the cover and a spring is connected between the button and the cover. The button is moved to move the blade slide from the initial position thereof to an extended position. When the blade is cutting a workpiece, the blade is tilt and the pivotal member is pivoted by the cover so that blade slide is retracted into the housing.

4 Claims, 10 Drawing Sheets

BOX CUTTER WITH RETRACTABLE BLADE

FIELD OF THE INVENTION

The present invention relates to a box cutter, and more particularly, to a box cutter with an automatically retractable blade.

BACKGROUND OF THE INVENTION

U.S. Pat. No. 6,148,520 discloses a conventional box cutter and generally comprises a blade slide and an activator, wherein the slide has a notch and the activator has a spring plate. The activator is moved linearly along a inclined axis. The user pushes a push button on outside of the housing of the box cutter to move the activator. The push button and the activator return by the force from a spring. When the activator moves forward, the spring plate is engaged with the notch so as to move the slide along a horizontal line so that the blade protrudes from the housing. When cutting a workpiece, the force applied to the blade by the user and the reaction force from the workpiece drive the blade to an extra distance which makes the spring plate be separated from the notch. By this separation, the activator can be returned and the blade is retracted into the housing by another spring when the blade removed from the workpiece.

However, the width and the space in the housing of the U.S. Pat. No. 6,148,520 has to be increased due to the inclined movement of the activator, but this makes the blade not to be protected by the housing and the blade is not stable when cutting the workpiece. Besides, the box cutter is designed for right-handed users.

U.S. Pat. No. 7,765,701 discloses a conventional box cutter and generally comprises a blade slide with a blade connected thereto. A protrusion extends from the rear end of the slide. An activator has a hook on the rear end thereof and the hook can push the protrusion of the slide so that the slide is pushed by the activator to move along the central axis of the housing. During the movement of the slide, two click spring pieces on two sides of the slide are constantly maintained below the eave-shaped guide on the inside of the housing. When cutting a workpiece, the force applied to the blade by the user and the reaction force from the workpiece make the blade and the slide pivot or swing so that one of the click spring pieces is separated from the guide of the housing and generates a sound to acknowledge the user. The hook and the protrusion are also separated from each other. Even when the user's finger still presses on the activator, the activator is maintained at the position where the blade is extended from the housing. The blade is retracted into the housing by another spring when the blade removed from the workpiece. During the processes, the activator is always located beside the protrusion so that the slide and the blade are retracted into the housing in an inclined status. The activator is then released, a spring pulls the activator backward and the protrusion of the activator is no longer stops the protrusion of the slide so that the slide and the blade return to the correct position from the inclined status.

It is noted that disclosed box cutter has a complicated structure and the inside of the housing includes an opening cutout, a constant clearance, an eave-shaped guide and a rib formed thereon. The slide is retracted in an inclined status which makes one side of the slide is easily worn out and deformed so that the balance of the slide can be easily affected. The slide and the blade return to the correct position until the activator returns to the initial position. Nevertheless, there are too many factors to affect the retraction of the slide, including fatigue of the spring, too much spring force, the friction between the slide and the housing, the click spring piece cannot be aligned with the opening cutout, or the click spring piece cannot return to the position below the guide. The fatigue of the spring and the friction between the slide and the housing may result that the hook is located beside the protrusion all the time so that the slide cannot return properly. When the blade and the slide are not correctly returned to the correct position, the user cannot observe the situation such that when the user pushes the activator again, the slide and the blade cannot protrude from the housing. Again, the box cutter is designed for right-handed users.

The present invention intends to provide a box cutter with an automatically retractable blade and the box cutter improves the drawbacks of the conventional ones.

SUMMARY OF THE INVENTION

The present invention relates to a box cutter and comprises a blade slide with and a blade received therein and two resilient members are connected to two sides of the blade slide respectively. A pivotal member is pivotably connected to the rear end of the blade slide and a first hook is connected to the front end of the pivotal member. An inclined face is defined in one of surfaces of the pivotal member and is gradually raised from the front end toward the rear end of the pivotal member. The inclined face is connected to a flat pressing area which has two respective rounded guide portions on two sides thereof. The rear end of the pivotal member has a push portion which is perpendicularly connected to the pressing area. A housing has a slide portion and the blade slide is slidably connected to the slide portion. A second hook is connected to the rear end of the housing. A cover is connected to the housing and covers up the interior of the housing. A spring is connected between the first and second hooks to maintain the blade slide at an initial position and to maintain the pivotal member to be inclined relative to the cover. A button is slidably connected to outside of the cover and has a block extending from the underside thereof. The block extends through an elongate hole and is inserted into the housing. A second spring is connected between the button and the cover to maintain the button at an initial position where the block contacts the push portion of the pivotal member. The button is moved to move the blade slide from the initial position thereof to an extended position. The cover has two pressing members on two sides of the underside thereof and each of the pressing members has a slide face which is shaped to match with the guide portion of the pivotal member. When the blade slide is located at the extended position, the pivotal member is located between the two pressing members.

When the blade slide is located at the extended position and the blade is tilt when cutting a workpiece. One of the resilient members is pushed toward the blade slide by the inside of the housing and one of the pressing members presses the pivotal member by the slide face which is cooperated with the guide portion of the pivotal member. The pivotal member is pressed to a substantially horizontal position so that the push portion of the pivotal member is separated from the block. Therefore, when the blade is removed from the workpiece, the blade slide is automatically retracted.

The primary object of the present invention is to provide a box cutter wherein when the blade slide is retracted, the blade slide is retracted along the central axis of the housing to ensure that the blade slide is not tilt to prevent from generating friction with the housing.

Another object of the present invention is to provide a box cutter wherein the two pressing members are located on the two sides of the underside thereof so that no matter which direction that the blade slide is tilt, at least one of pressing members presses the blade slide. Therefore, the blade can be installed to the blade slide upside down such that the left-handed users can use the box cutter.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
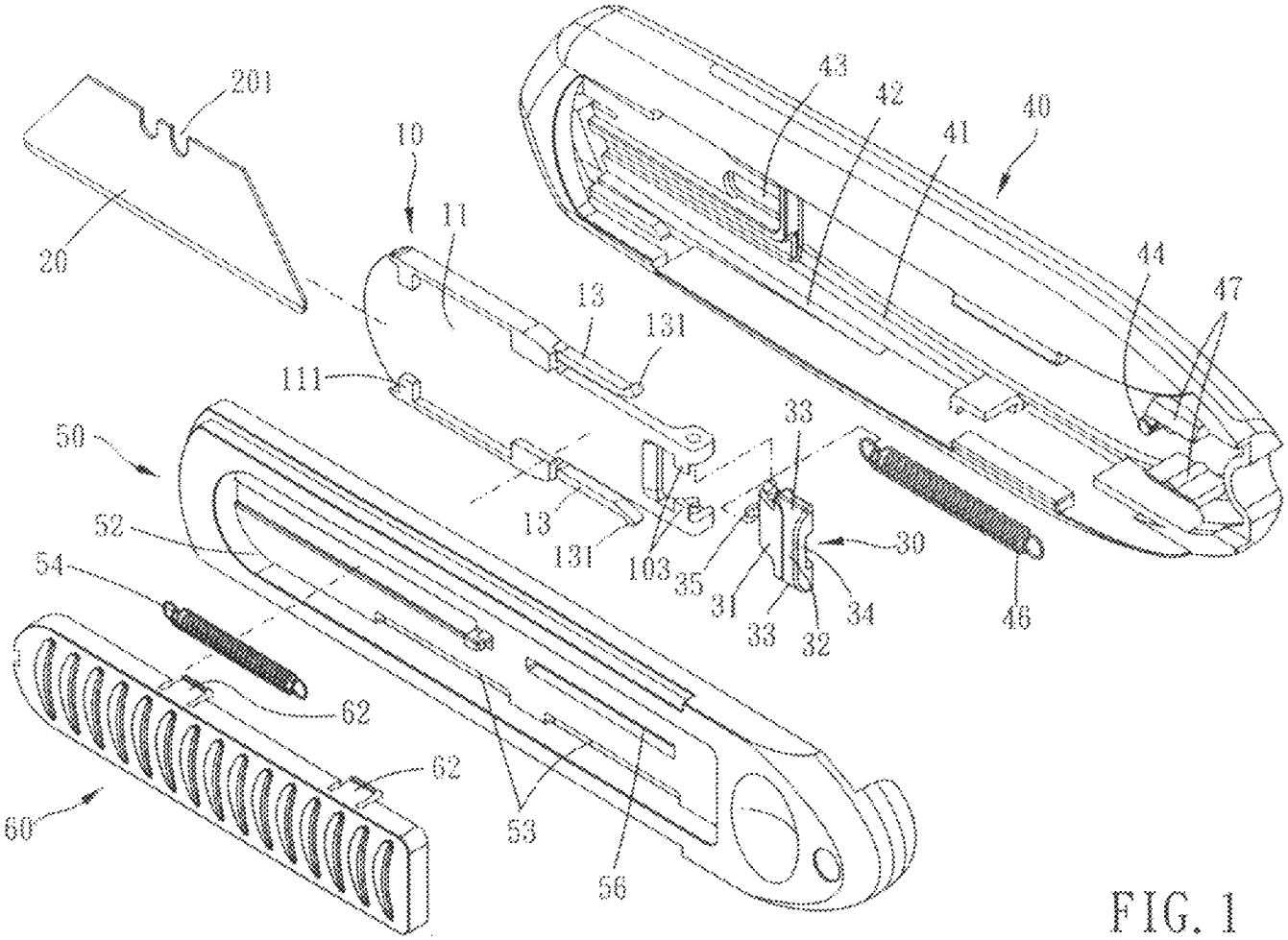
FIG. 1 is an exploded view to show the box cutter of the present invention.

Referring to FIGS. 1 to 5, the box cutter of the present invention comprises a board-like blade slide 10 which has a slot 11 and a blade 20 is located in the slot 11. Two restriction parts 111 respectively extend from two insides of the slot 11 so as to be engaged with a notch 201 of the blade 20 to position the blade 20 in the slot 11. A restriction plate 12 is connected to the back of the blade slide 10 and two resilient members 13 are connected to two sides of the blade slide 10 respectively. Each of the resilient members 13 has a protrusion 131 on the distal end thereof. A pivotal member 30 is pivotably connected to the rear end of the blade slide 10 and the rear end of the blade slide 10 has a stud 103 to restrict height of the tilt of the pivotal member 30.

A first hook 35 is connected to the front end of the pivotal member 30 and an inclined face 31 is defined in the front surface of the pivotal member 30. The inclined face 31 is gradually raised from the front end toward the rear end of the pivotal member 30. The inclined face 31 is connected to a flat pressing area 32 which has two respective rounded guide portions 33 on two sides thereof. The rear end of the pivotal member 30 has a push portion 34 which is perpendicularly connected to the pressing area 32.

A housing 40 receives the blade slide 10 therein and two slide portions 41 are formed on the two sides of the housing 40. The blade slide 10 is slidably connected to the slide portion 41 and the two protrusions 131 of the two resilient members 13 contact the inside of the housing 40. Two cover slide portions 42 are formed on the two sides of the housing 40. A recessed restriction area 43 is formed in the housing 40 and located close to the front end of the housing 40. A second hook 44 is connected to the rear end of the housing 40. The restriction plate 12 is located in the restriction area 43. A spring 46 has one end connected to the second hook 44, and the other end of the spring 46 toes beneath the pivotal member 30 and is connected to the first hook 35 so as to maintain the blade slide 10 at the initial position and maintain the pivotal member 30 to be inclined relative to the cover 50. The stud 103 properly restricts the tilt status of the blade slide 10.

A cover 50 is slidably connected to the cover sliding portions 42 of the housing 40 so as to cover up the interior of the housing 40. Each of the cover 50 and the housing 40 has a positioning device 51/47 at the distal end thereof, the positioning devices 51, 47 can be connected to each other when the cover 50 is connected to the housing 40, or separated from each other when the cover 50 is separated from the housing 40. A space 52 is defined in the top of the cover 50 so as to accommodate the button 60. The button 60 has a block 62 extending from the underside thereof and the block 62 movably extends through a first elongate hole 53 of the cover 50 so that the button 60 is movable in the space 52. A second spring 54 is connected between the button 60 and the cover 50 to maintain the button 60 at the initial position. The cover 50 further has a second elongate hole 56 and the a block 63 extends through the second elongate hole 56 and is inserted into the housing 40, wherein the block 63 contacts the push portion 34 of the pivotal member 30 when the blade slide 10 is located at its initial position. The cover 50 has two pressing members 55 on two sides of the underside thereof and each of the pressing members 55 has a slide face 551 which is shaped to match with the guide portion 33 of the pivotal member 30.

Figure 5:
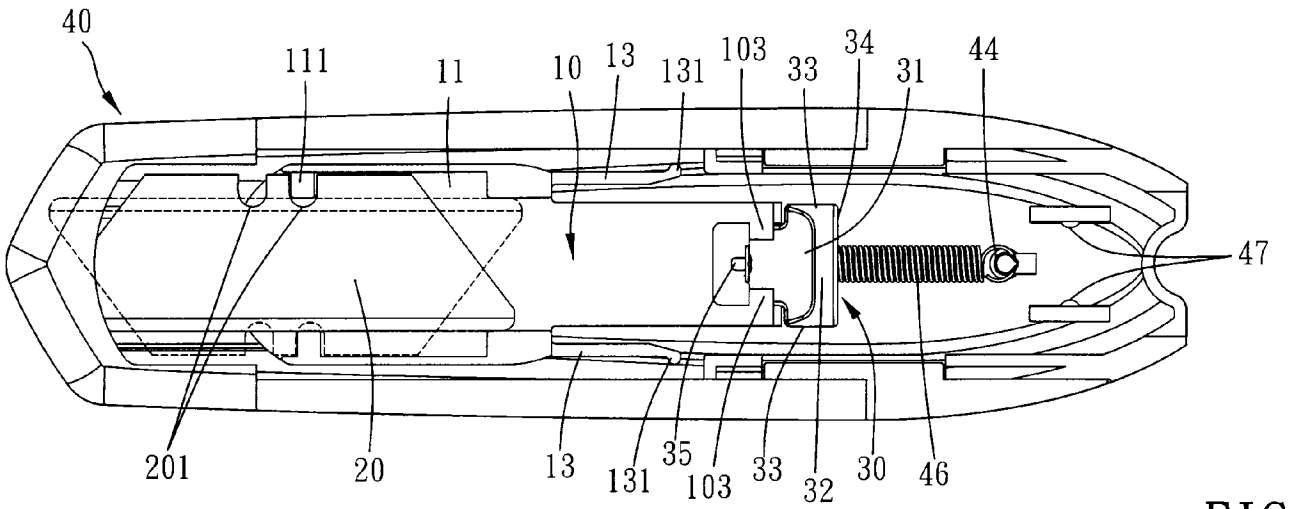
FIG. 5 is a cross sectional view taken along line 5-5 in FIG. 4.
Figure 6:
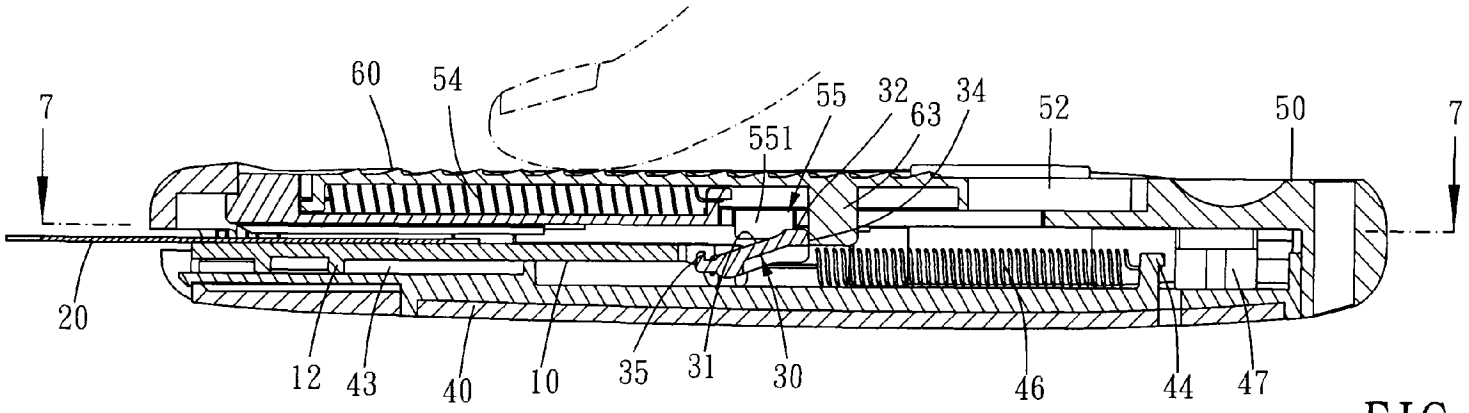
FIG. 6 shows a side cross sectional view of the box cutter of the present invention, wherein the blade is extended beyond the housing.
Figure 7:
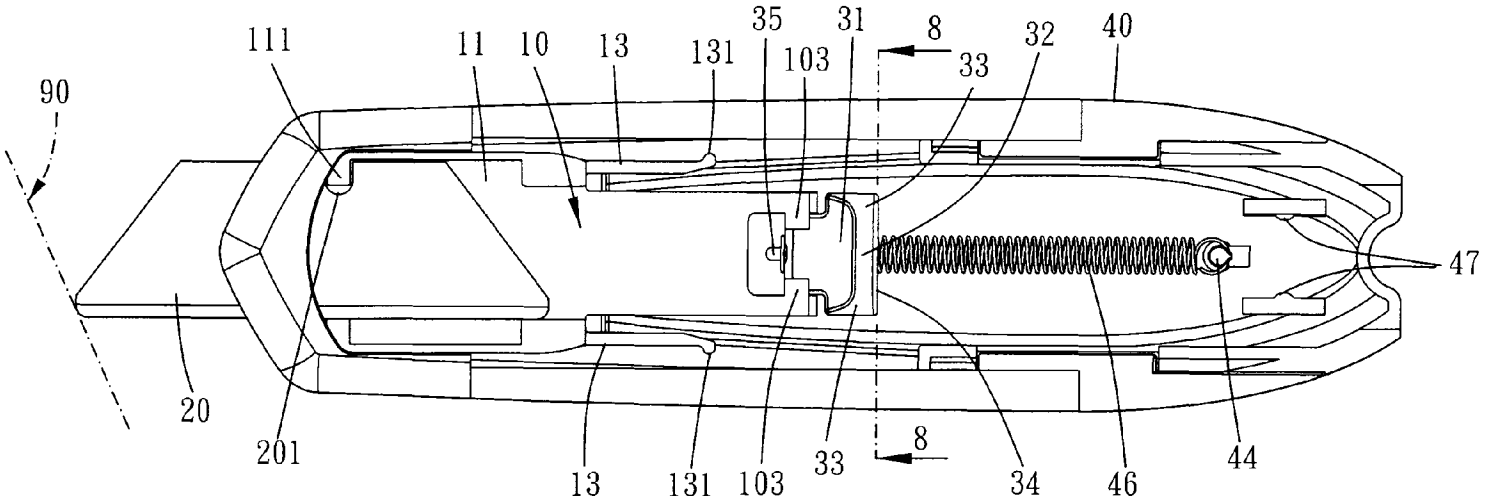
FIG. 7 is a cross sectional view taken along line 7-7 in FIG. 6.

As shown in FIGS. 6 and 7, the user uses the thumb to push the button 60 forward and the block 63 of the button 60 pushes the push portion 34 of the pivotal member 30 to let the blade slide 10 moved with the button 60. The blade 20 extends beyond the front ends of the housing 40 and the cover 50, this is the extended position of the blade 20 and the blade slide 10. During the movement of the button 60, the blade 20 and the blade slide 10 are moved from the initial position (FIGS. 4 and 5) to the extended position (FIGS. 6 and 7), the user can release the button 60 anytime, the first and second springs 46, 54 pull the button 60, the blade slide 10 and the blade 20 back to the initial position.

Figure 8:
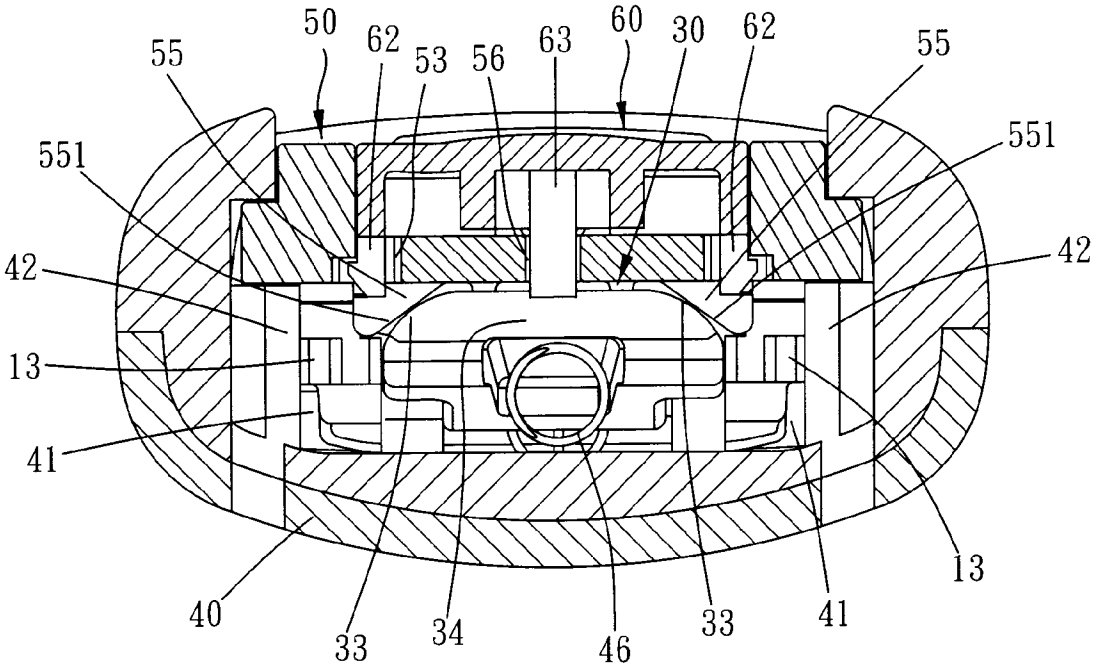
FIG. 8 is a cross sectional view taken along line 8-8 in FIG. 7.

As shown in FIG. 8, when the button 60, the blade 20 and the blade slide 10 are located at the extended position, the pivotal member 30 is located between the two pressing members 55.

Figure 9:
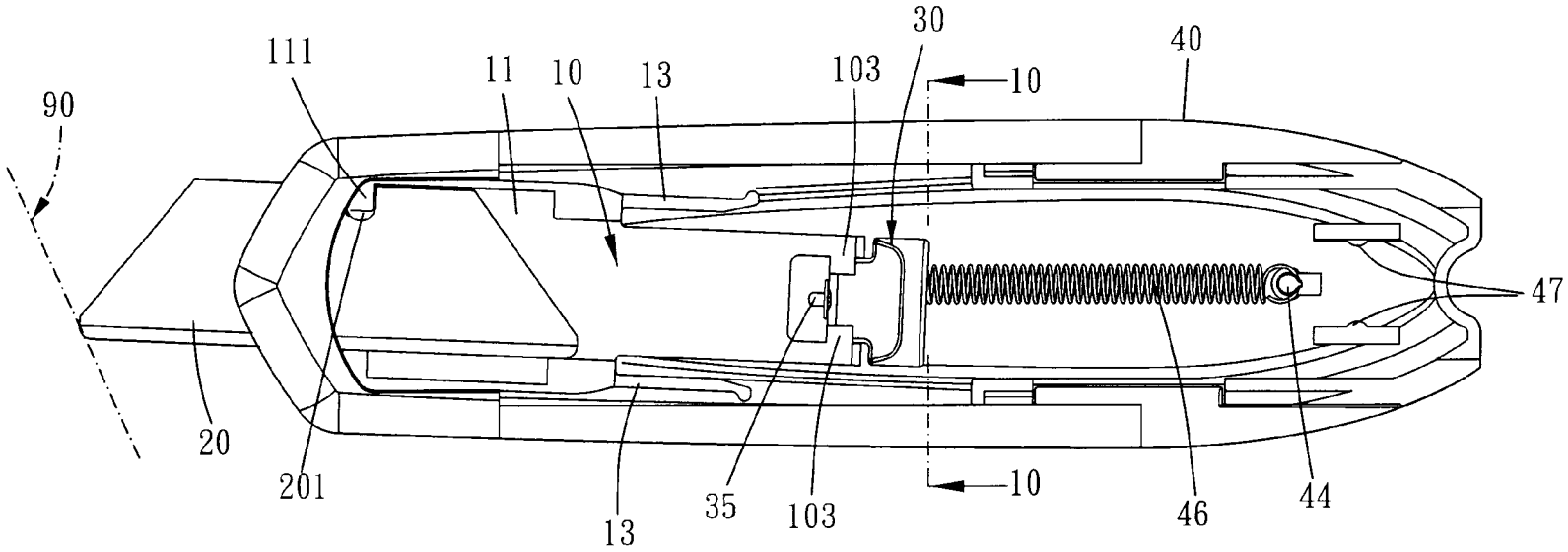
FIG. 9 is a cross sectional view to show that the blade and the blade slide are tilt when cutting a workpiece.
Figure 10:
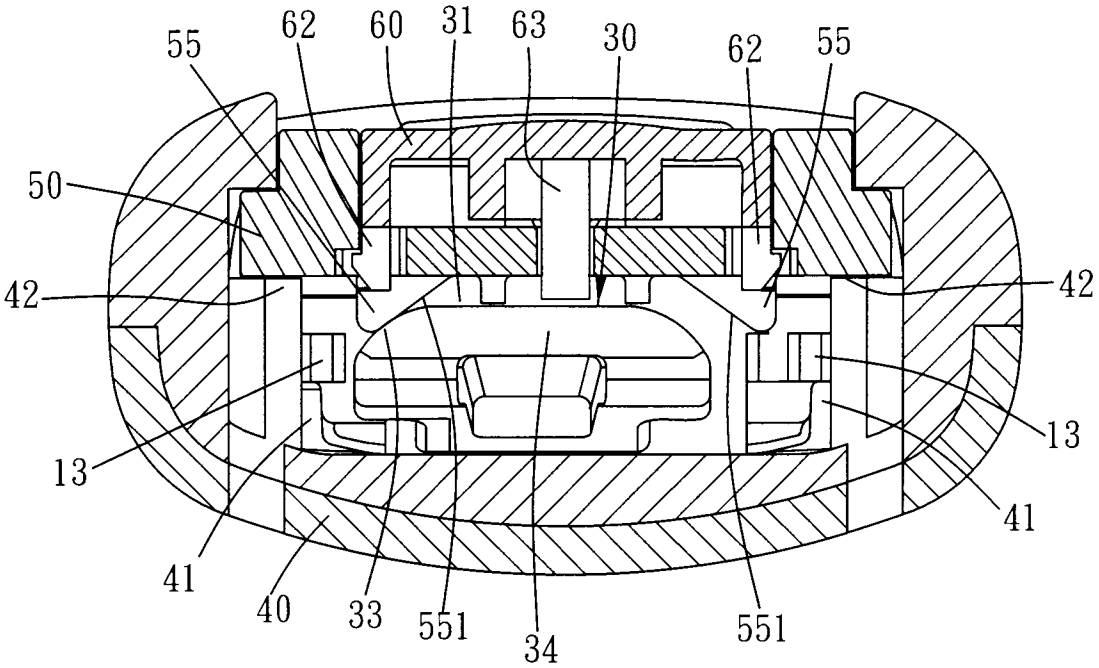
FIG. 10 is a cross sectional view taken along line 10-10 in FIG. 9.
Figure 11:
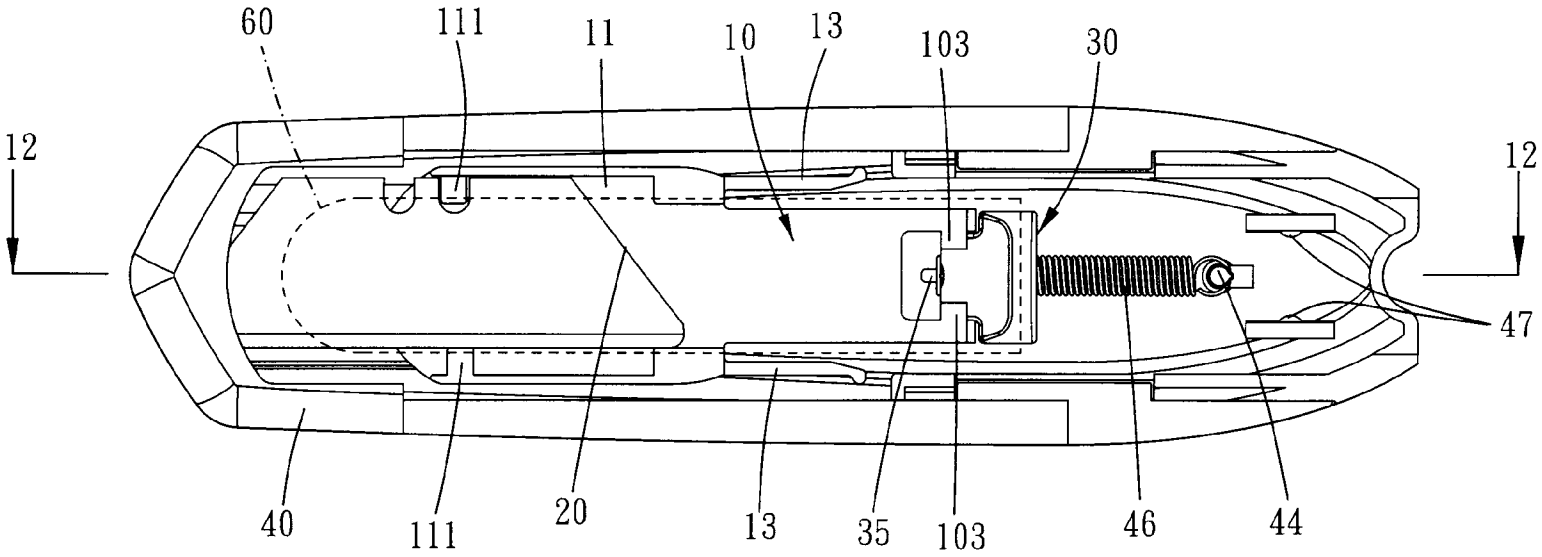
FIG. 11 shows that the blade is retracted from its extended position to the initial position.
Figure 12:
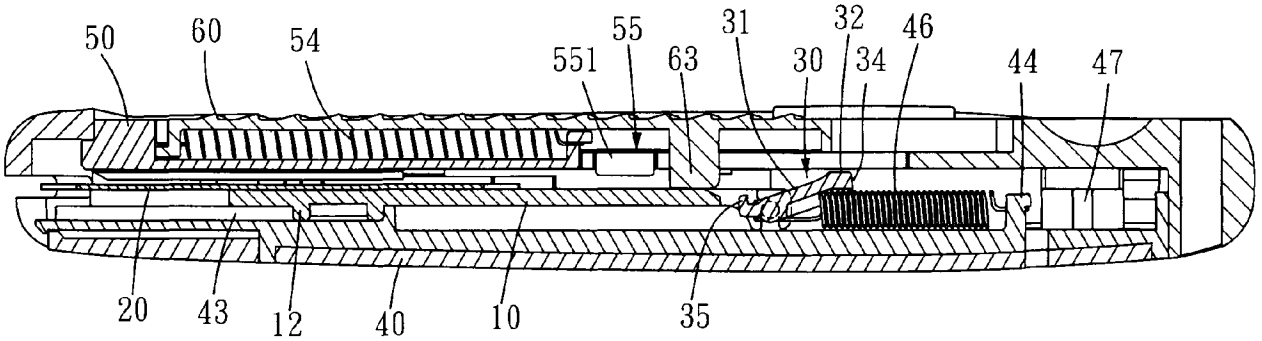
FIG. 12 is a cross sectional view taken along line 12-12 in FIG. 11.

As shown in FIG. 10, when the button 60, the blade 20 and the blade slide 10 are located at the extended position, the blade 20 can be used to cut a workpiece 90 which applies a reaction force to the blade 20 to tilt the blade 20 and the blade slide 10. The blade slide 10 tilts about the restriction plate 12 in the restriction area 43. One of the resilient members 13 is pressed by the tilt of the blade slide 10 and moves toward the side of the blade slide 10, and the pivotal member 30 tilts toward the same direction. By the cooperation between the slide face 551 on the pressing member 55 and the guide portion 33 of the pivotal member 30, the pivotal member 30 is pressed by one of the pressing members 55. The pivotal member 30 is tilted from the status shown in FIGS. 4, 5 and 8 to the status shown in FIGS. 9 and 10. Therefore, the push portion 34 of the pivotal member 30 is separated from the block 63 of the button 60. As shown in FIGS. 11 and 12, once the blade 20 is removed from the workpiece 90, even if the button 60 is still located at the extended position, the blade slide 10 is pulled back to the initial position by the first spring 46. It is noted that when the reaction force is disappear, the compressed resilient member 13 releases the energy to pull the blade slide 10 back to its correct position so that the blade slide 10 moves back along the central axis of the housing 40, and the movement is smooth and balanced. Friction is not happened to either side or any portion of the blade slide 10.

Figure 13:
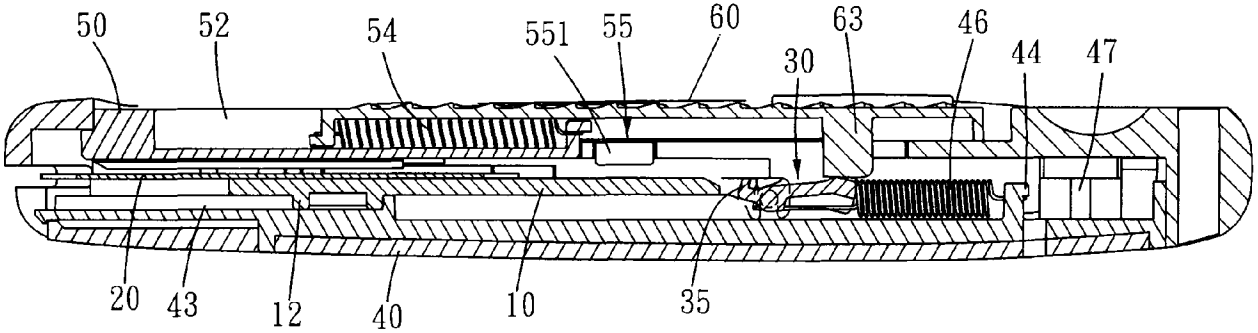
FIG. 13 shows that the button is retracted from its extended position to the initial position.

As shown in FIG. 13, when the user apples extra force to pushes the button 60, the second spring 54 releases energy to pull the button 60 back to its initial position. During the movement of the button 60, the block 63 moves over the inclined face 31 of the pivotal member 30 and presses the pivotal member 30 downward, the block 63 moves over the pivotal member 30 and returns to the initial position.

Figure 2:
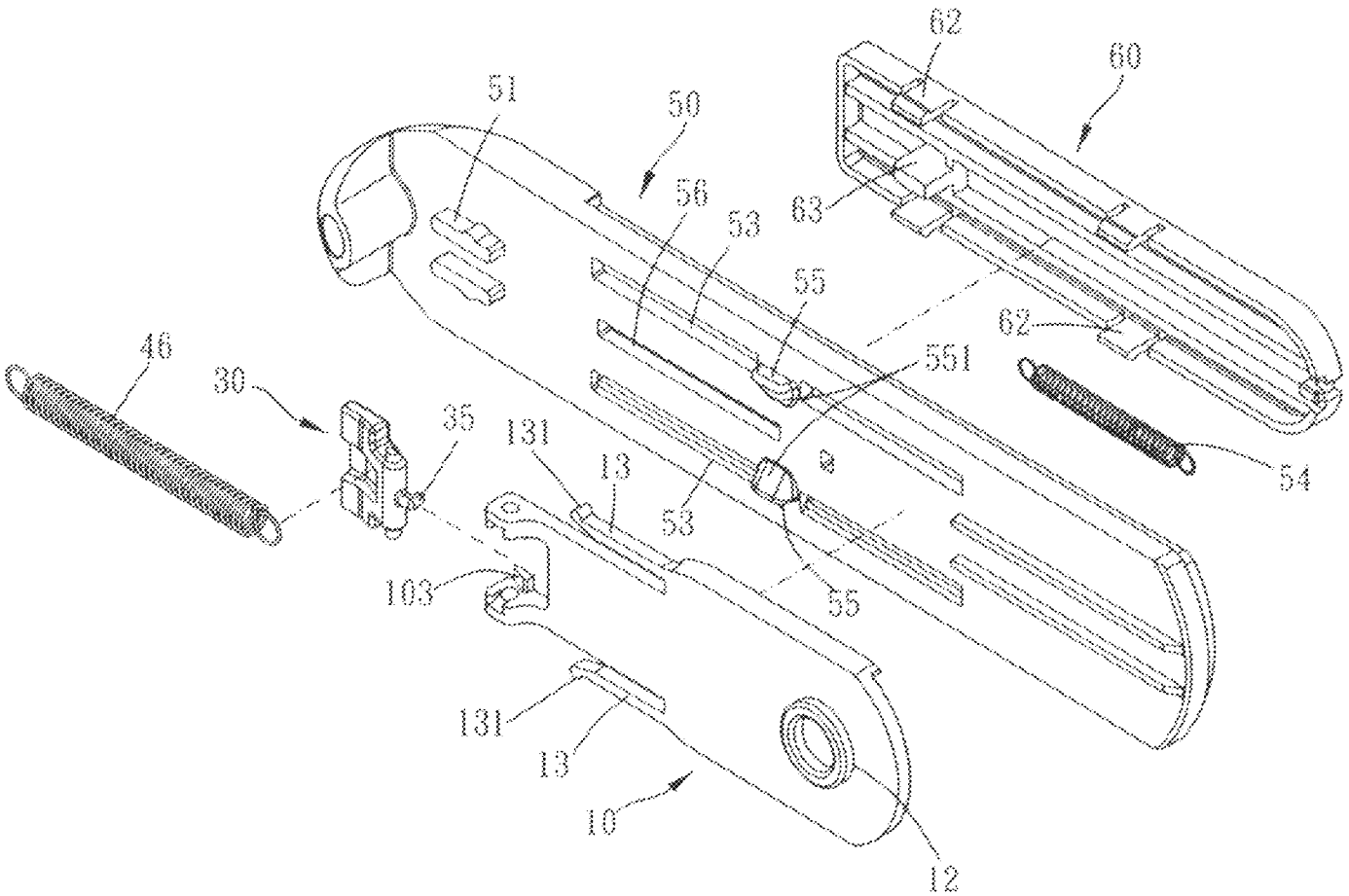
FIG. 2 is another exploded view to show the box cutter of the present invention.
Figure 3:
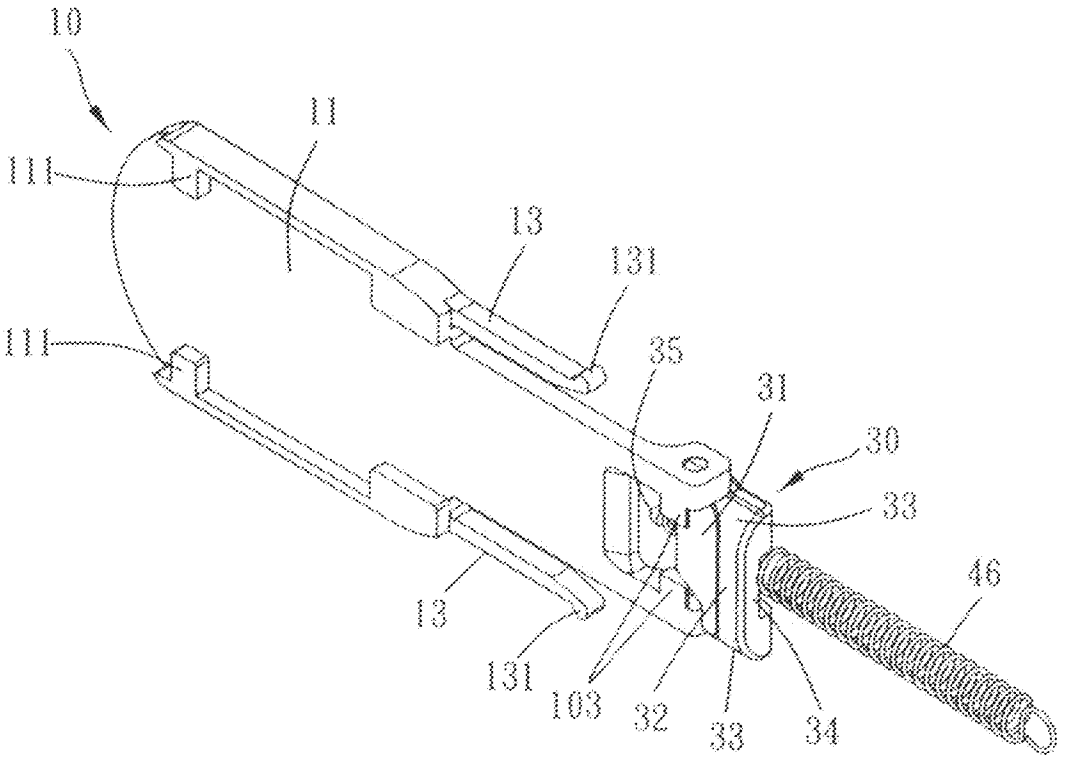
FIG. 3 shows the combination of the blade slide and the pivotal member.
Figure 4:
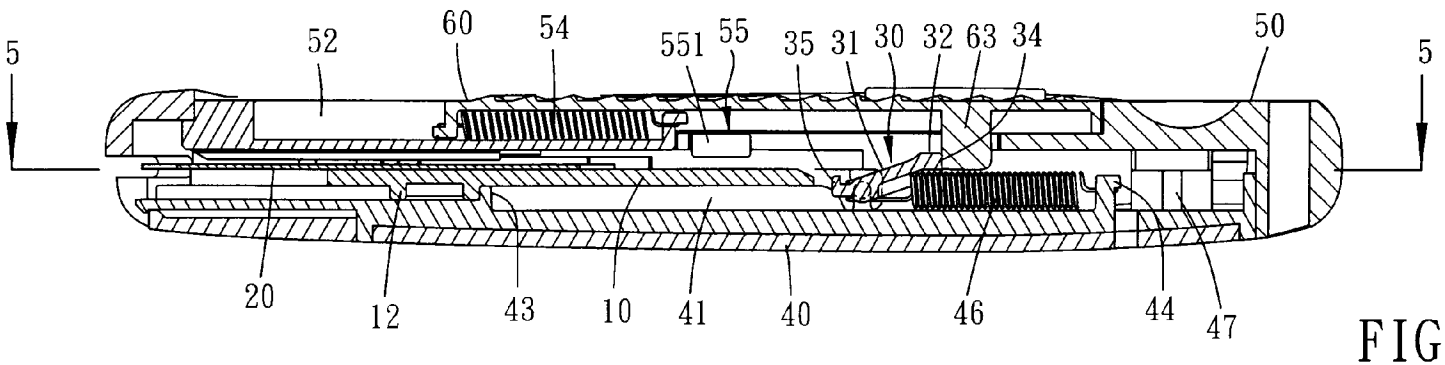
FIG. 4 shows a side cross sectional view of the box cutter of the present invention.

As shown in FIG. 2, there are two pressing members 55 on two sides of the cover 50 and one of the pressing members 55 presses the pivotal member 30 no matter which direction that the blade slide 10 tilts. Therefore, as shown in FIG. 5, the blade 20 can be installed in two directions as shown in solid and dotted lines, and both right-handed users and left-handed users can use the box cutter.

While we have shown and described the embodiment in accordance with the present invention, it should be clear to those skilled in the art that further embodiments may be made without departing from the scope of the present invention.

What is claimed is:

1. A box cutter comprising:

a blade slide and a blade received in the blade slide, two resilient members connected to two sides of the blade slide respectively;

a pivotal member pivotably connected to a rear end of the blade slide and a first hook connected to a front end of the pivotal member, an inclined face defined in one of surfaces of the pivotal member, the inclined face gradually raised from the front end toward a rear end of the pivotal member, the inclined face connected to a flat pressing area which has two respective rounded guide portions on two sides thereof, the rear end of the pivotal member has a push portion which is perpendicularly connected to the pressing area;

a housing having a slide portion and the blade slide slidably connected to the slide portion, a second hook connected to a rear end of the housing;

a cover connected to the housing and covering up an interior of the housing;

a spring connected between the first and second hooks and maintaining the blade slide at an initial position and maintaining the pivotal member inclined relative to the cover;

a button slidably connected to outside of the cover and having a block extending from an underside thereof, the block extending through an elongate hole and inserted into the housing, a second spring connected between the button and the cover to maintain the button at an initial position where the block contacts the push portion of the pivotal member, the button being moved to move the blade slide from the initial position thereof to an extended position, and the cover having two pressing members on two sides of an underside thereof and each of the pressing members having a slide face which is shaped to match with the guide portion of the pivotal member, when the blade slide is located at the extended position, the pivotal member is located between the two pressing members.

2. The box cutter as claimed in claim 1, wherein when the blade slide is located at the extended position, the blade is tilt when cutting a workpiece and one of the resilient members is pushed toward the blade slide by an inside of the housing, one of the pressing members presses the pivotal member by the slide face which is cooperated with the guide portion of the pivotal member, the pivotal member is pressed to a substantially horizontal position so that the push portion of the pivotal member is separated from the block.

3. The box cutter as claimed in claim 1, wherein the rear end of the blade slide has a stud to restrict the tilt of the pivotal member.

4. The box cutter as claimed in claim 1, wherein the blade slide has a slot and the blade is located in the slot, two restriction parts respectively extend from two insides of the slot and engaged with a notch of the blade.

* * * * *